US005092495A

United States Patent [19]

Andre

[11] Patent Number: 5,092,495

[45] Date of Patent: Mar. 3, 1992

[54] PRECOMPRESSION PUMP FOR SPRAY DISCHARGE OF A LIQUID

[75] Inventor: DeBard Andre, Buc, France

[73] Assignee: Lindal Verpackungstechnik GmbH & Co. KG, Bad Oldesloe, Fed. Rep. of Germany

[21] Appl. No.: 668,958

[22] Filed: Mar. 13, 1991

[51] Int. Cl.[5] ..... B65D 88/54

[52] U.S. Cl. ..... 222/341; 222/321; 222/385; 239/333; 417/559

[58] Field of Search ..... 222/321, 341, 385, 496, 222/383, 340; 239/333, 533.1, 574, 340; 417/552, 559, 555.1

[56] References Cited

U.S. PATENT DOCUMENTS

| | | | |
|---|---|---|---|
| 4,462,549 | 7/1984 | Saito et al. | 222/321 X |
| 4,693,675 | 9/1987 | Venus, Jr. | 222/321 X |
| 4,830,284 | 5/1989 | Maerte | 239/333 |
| 4,936,492 | 6/1990 | Amiel et al. | 222/321 X |
| 4,941,595 | 7/1990 | Montaner et al. | 222/321 |
| 4,944,432 | 7/1990 | Jouillat | 222/321 |
| 4,964,547 | 10/1990 | Lina | 222/385 |
| 5,002,207 | 3/1991 | Giuffredi | 222/340 |

FOREIGN PATENT DOCUMENTS

| | | |
|---|---|---|
| 0127449 | 12/1984 | European Pat. Off. . |
| 2133259 | 11/1972 | France . |
| 2631393 | 11/1989 | France . |

*Primary Examiner*—Michael S. Huppert
*Assistant Examiner*—Gregory L. Huson
*Attorney, Agent, or Firm*—Felfe & Lynch

[57] ABSTRACT

A precompression pump for discharging a liquid in spray form has a first inner compression chamber formed within a pump body between a valve for closing an orifice through which liquid is withdrawn from a storage container and a discharge orifice through which the withdrawn liquid is expelled to a spray-discharge head. The volume of the first chamber is variable by means of a driving piston which is continuously urged by a first helical spring towards a position corresponding to the maximum volume. A second intermediate chamber is located between the first chamber and the discharge orifice, this orifice being shut-off by a needle-valve piston which forms the precompression system. The needle-valve piston is mounted within a moving element but outside the first chamber and urged by a second helical spring to a position of closure of the discharge orifice. A free-running piston is thrust by flexible tongues to a position in which it cuts-off the communication between the first inner chamber and the second chamber.

14 Claims, 7 Drawing Sheets

PRECOMPRESSION PUMP FOR SPRAY DISCHARGE OF A LIQUID

BACKGROUND OF THE INVENTION

1. Field of the Invention

The present invention relates to spray-discharge pumps such as the pumps of the so-called aerosol type which are employed for extracting a predetermined quantity of a liquid from a storage container and discharging it to the exterior through a spray-discharge head which is usually equipped with a vertical flow nozzle. Among the pumps of the type considered, the invention is more particularly concerned with those in which the dose of liquid withdrawn is subjected to preliminary compression before being discharged to the exterior.

2. Description of the Prior Art

Pumps of this type have a compression chamber formed within a pump body between a valve having the function of closing the orifice through which liquid is withdrawn from the storage container and an orifice through which the withdrawn liquid is expelled to the spray-discharge head. The compression chamber has a variable volume since it is limited by a piston carried by an element which is capable of axial displacement within the pump body. This element is connected to the spray-discharge head in such a way that a pressure exerted manually on the head by the user in opposition to resilient restoring means makes it possible to initiate operation of the pump.

The invention meets the need to improve the operation of pumps of this type, especially in order to ensure free spray discharge of the liquid in a predetermined dose, in order to avoid dripping or running at the end of a spraying operation or outside periods of use, and in order to permit simple and rugged construction while guaranteeing efficient operation over a long period of service.

These objectives are achieved by the invention, essentially by resorting to an arrangement which produces a precompression effect and involves the use of two chambers, one of which is a variable-volume compression chamber which is internal to the moving element whilst the other chamber is external to said moving element and establishes a communication with the discharge orifice located at the end of the moving element by means of longitudinal ducts formed annularly in said element. Moreover, a needle-valve piston is mounted within the moving element but outside the inner chamber so as to close the discharge orifice when the pressure of liquid within the outer chamber provided with the communication ducts has fallen to zero. This needle-valve piston or precompression piston also performs the function of a snifting piston which prevents running at the start of a spraying operation by virtue of the fact that it is urged by associated resilient means to a position of closure of the discharge orifice, the piston being freed from the orifice when the liquid is put under pressure within the outer chamber or intermediate chamber.

The invention advantageously involves a secondary feature of the pump which is accordingly capable of changing from a single-acting to a double-acting mode of operation. In accordance with this secondary feature, a free-running piston provided within the inner chamber of the main piston or driving piston is thrust by resilient means into a position in which it cuts-off the communication between the inner chamber and the outer chamber and is subsequently moved away from this position only under the action of a pressure of liquid within the inner chamber. When a pump of this type is in operation, a first part of the dose of liquid withdrawn is discharged through the outer chamber when the piston is caused to move downwards in the direction of compression within the inner chamber whilst the remainder of this dose is discharged during upward return of the driving piston which is subject to the associated resilient means.

In the practical construction of the pump, the different resilient means are usually helical metal springs. However, the free-running piston of the double-acting pump is preferably urged to its closed position by tongues of elastic material molded with a transverse partition-wall which is formed internally of the moving element and limits the inner chamber. In addition, the spring associated with the needle-valve piston is applied against the opposite face of the partition-wall.

So-called "double-acting" precompression pumps are known in which a first part of the withdrawn dose of liquid is discharged through an outer chamber when the piston is caused to move downwards in the direction of compression within an inner chamber whilst the remainder of the dose considered is discharged at the time of upward return of the driving piston which is subjected to the associated resilient means.

A pump of this type is known and has been disclosed in particular in European patent Application No. 0127449 in which leak-tightness between the outer chamber and the inner chamber is ensured by means of an elastic sleeve which is intended to close the communication orifices between the two chambers. In the solution proposed in the cited patent Application, the sleeve is provided with grooves which put an intermediate chamber into communication with the liquid discharge duct. Moreover, the moving element which actuates the driving piston whose intended function is to vary the internal volume of a first compression chamber acts on the driving piston by means of this sealing element. There therefore exists an incompatibility between the elasticity which the sleeve must have in order to ensure leak-tight flow of the fluid from the first compression chamber to the intermediate chamber and the concomitant need to ensure that the sleeve has sufficient rigidity to be capable of transmitting the mechanical effort required for downward displacement of the piston in order to reduce the internal volume of the first chamber and to vary the volume of the intermediate chamber.

A further object of the invention is to propose a precompression pump which makes it possible to ensure a high standard of leak-tightness between a first inner chamber and a second chamber while having elements of simple constructional design which can readily be mounted.

SUMMARY OF THE INVENTION

In accordance with the invention, the precompression pump for spray discharge of a liquid is provided with a first inner compression chamber arranged within a pump body between a valve for closing an orifice through which liquid is withdrawn from a storage container and a discharge orifice through which the withdrawn liquid is expelled to a spray-discharge head. The volume of the first chamber is variable by reason of the fact that this chamber is limited by a driving piston thrust axially by a moving element within the pump body, the driving piston being continuously urged by first resilient means to a position corresponding to the maximum volume of the first chamber. The pump is also provided with a second intermediate chamber between the first chamber and the discharge orifice which is shut-off by a second valve forming the precompression system and mounted within an internal space of the moving element. The second valve is urged by second resilient means to a position of closure of the discharge orifice from which the second valve is withdrawn in spite of the action of the second resilient means when the liquid is pressurized within the second chamber. The moving element is provided with communication ducts which are distributed annularly and open laterally towards the second chamber on an elastic sealing sleeve mounted on the periphery of the moving element at the level of the communication ducts. In accordance with a distinctive feature, the elastic sleeve is mounted between the second chamber and a third chamber, the moving element bears directly on the driving piston, and a third valve placed within a third chamber which is internal to the moving element is urged by third resilient means towards the driving piston to a position in which it closes an orifice of the driving piston which puts the third chamber into communication with the first chamber.

In accordance with another distinctive feature of the invention, the second and third valves are rubber needle-valve pistons.

In accordance with yet another distinctive feature, the first and third valves are rubber balls.

In accordance with still another distinctive feature, the third chamber has longitudinal grooves parallel to the axis of symmetry of the moving element.

In an alternative embodiment, the grooves are formed on part of the moving element.

In another alternative embodiment, the grooves are formed on the driving piston.

A further object of the invention is to permit easy construction and assembly of a pump of this type.

This object is achieved by the fact that the driving piston is a part which is independent of the moving element.

DESCRIPTION OF THE PREFERRED EMBODIMENTS

Figure 1:
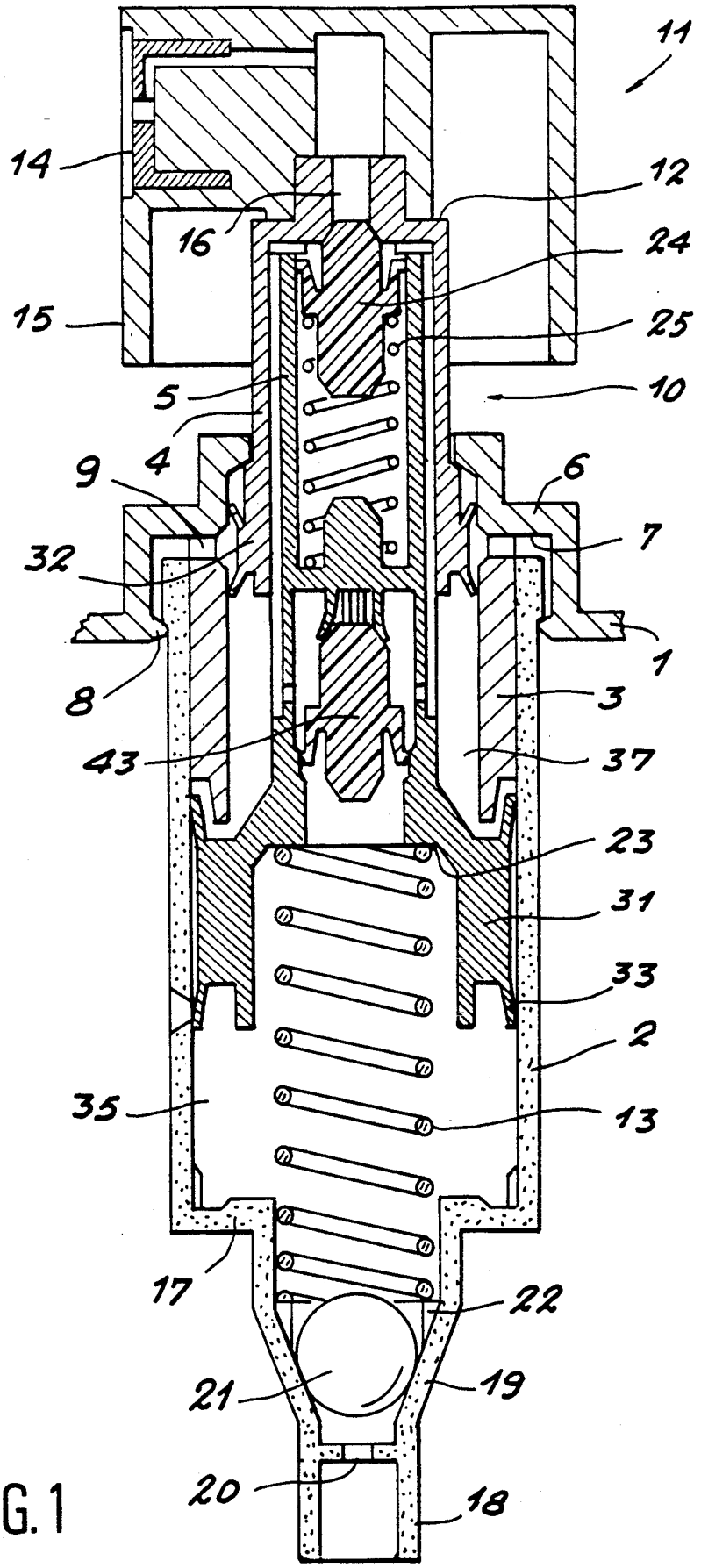
FIG. 1 is a schematic longitudinal sectional view of a double-acting design of the pump herein described, the pump being shown in its inactive position when it is not in use.
Figure 2:
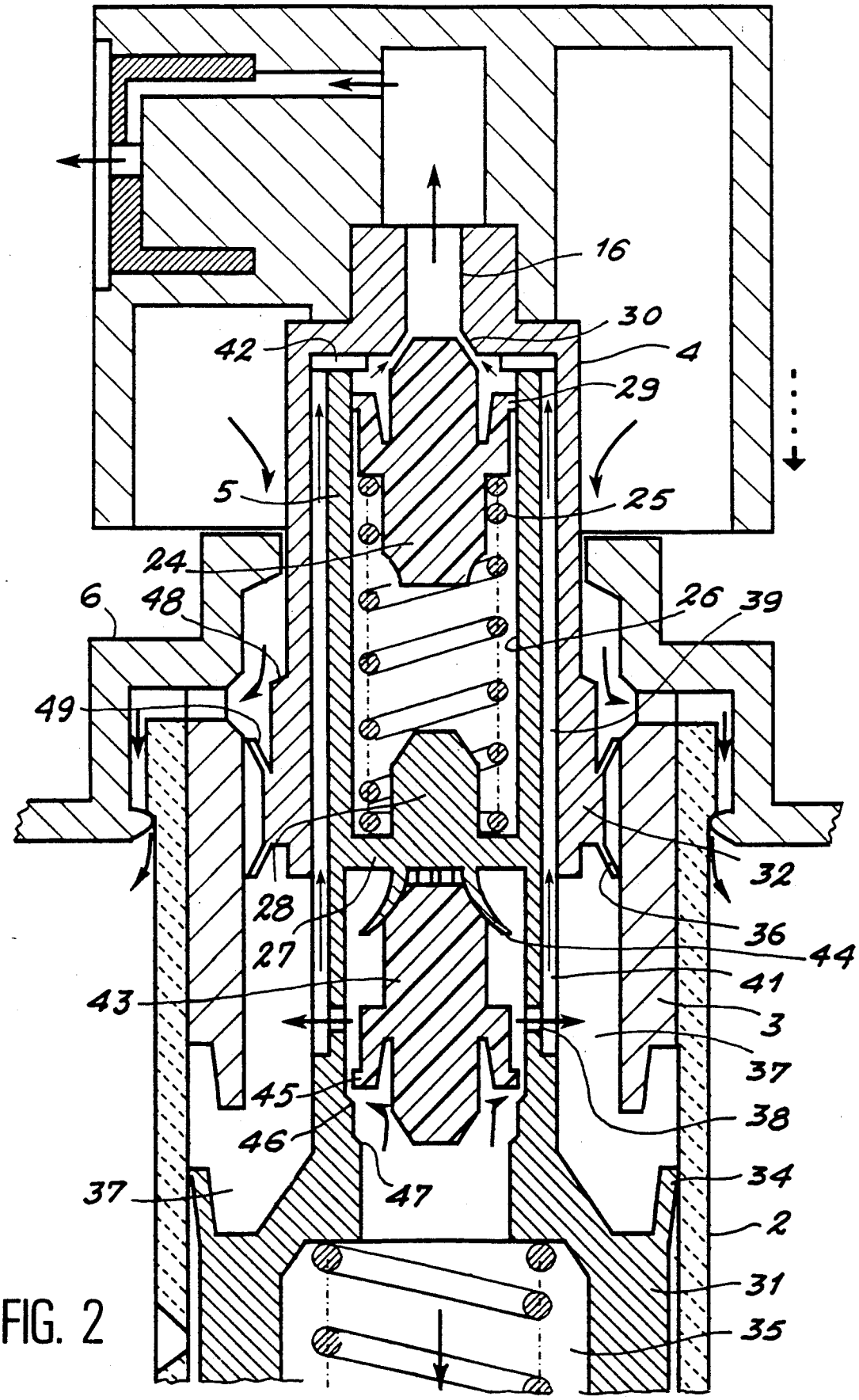
FIG. 2 is a similar cross-section but in an enlarged and partial view corresponding to the position occupied by the different pump components when the driving piston is moving downwards during a compression stage at the start of a discharge of liquid.
Figure 3:
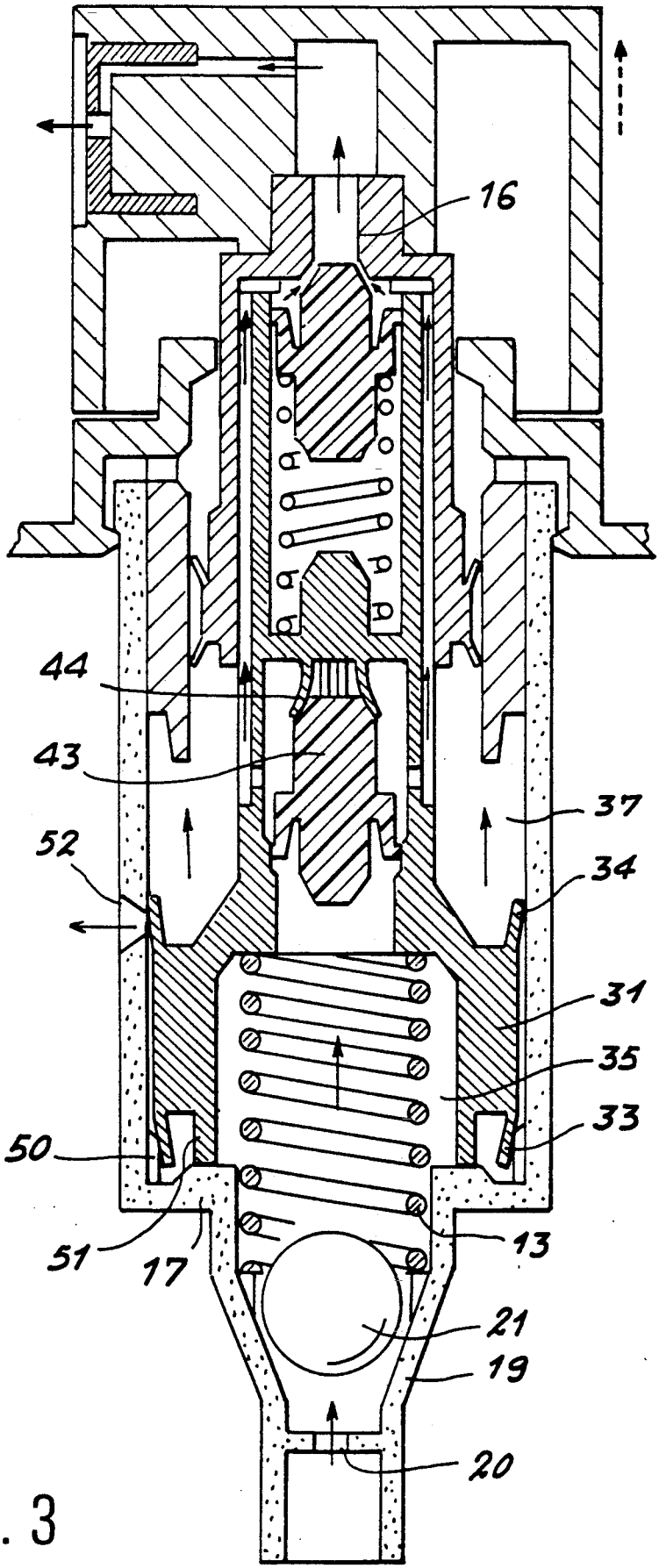
FIG. 3 is a sectional view which is similar to that of FIG. 1 when the piston has completed its downward travel and begins to return upwards in the second liquid discharge stage.

In the particular embodiment considered, the double-acting pump in accordance with the invention is shown in FIGS. 1 to 3 in different positions of its constituent elements, the same reference numerals being retained in each position. The pump has a axis of symmetry of revolution which is assumed to be oriented in the vertical direction, as is normally the case when the pump is in use for withdrawing and delivering in spray form a liquid stored in a container, only the closure cap 1 of which has been illustrated.

This pump includes a moving system which is capable of axial displacement within a stationary pump body mounted within the container. The pump body is constituted by a shell 2 lined with a sleeve 3 in the upper portion of the shell. The moving system essentially includes a cylindrical element 10 made up of two parts in rigidly fixed relation, namely an inner tube 5 and an outer tube 4 which covers the upper end of the inner tube 5. The container closure cap 1 forms a small cylindrical cup 6 through which the moving element 10 passes and which has a internal annular shoulder 7. The pump body is mounted beneath the internal annular shoulder by snap-action engagement of the upper end of the shell 2 behind beads 8 of the closure cap 1. However, a leakage air flow is permitted to take place between the beads in order to ensure pressure equalization with the container. For this purpose, the upper end of the sleeve 3 is provided with lugs 9 abuttingly applied against the annular shoulder 7 of the small cup 6 beyond the end face of the upper end of the shell 2.

A spray-discharge 11 head is mounted on the moving system by forcible engagement on the upper end of the outer tube 4 and abuttingly applied on an external annular shoulder 12 formed for this purpose on the tube. The spray-discharge head enables the user to control the operation of the pump. When a downward manual pressure is applied on the discharge head by the user, the result thereby achieved is to exert a thrust on the moving system and to move it downwards in opposition to the elastic restoring force of a helical spring 13 to which further reference will be made hereafter. The spray-discharge head 11 is also provided with a spray-discharge nozzle 14 of the vortical flow type which opens laterally through a cylindrical skirt 15. The skirt limits the head 11 externally and communicates through the head 11 with the internal space of the moving element 10. The tube 4 forms axially an orifice 16 which serves to discharge the liquid withdrawn from the container by the pump.

This withdrawal of liquid takes place through the lower portion of the stationary body of the pump, in which the shell 2 has an extension of smaller cross-section after an annular bottom wall 17 so as to form first a valve-seat 19 of frusto-conical shape, then a dip tube 18 which is open at the lower end of the container (not shown). A liquid withdrawal orifice 20 either puts the internal space of the pump into communication with the tube 18 or does not do so, depending on the position taken up by a ball 21 forming a valve with respect to the cooperating valve-seat 19, under the action of a pressure of liquid exerted on the ball. Around the ball 21, the pump body is provided internally with pillars 22 on which the lower end of the spring 13 is applied. The inner tube 5 of the moving element has an extension in the form of a driving piston 31 which surrounds the spring 13 and forms an internal annular shoulder 23 which serves as a bearing surface for the upper end of the spring. Although this is not clearly apparent from the figures, the shape and dimensions of the spring 13 are such that the ball 21 cannot engage therein and that its displacements are thus limited to a range of travel corresponding substantially to the height of the pillars 22.

The double-acting pump of the embodiment shown in FIGS. 1 to 3 has two variable-volume compression chambers. An additional feature of the pump is that the withdrawn liquid reaches the discharge orifice 16 via the exterior of a precompression system essentially constituted by a needle-valve piston 24 which closes said orifice as long as the pressure exerted thereon by the liquid is not sufficient to overcome the elastic restoring force of a helical spring 25. This spring is housed within a blind-end bore 26 (FIG. 2) formed within the inner tube 5 and extending from the upper end of the tube to a transverse partition-wall 27. The spring is compressed between the partition-wall and an annular bearing surface of the needle-valve piston 24 and maintained laterally between the tube 5 and on the one hand the piston itself and on the other hand an axial projection 28 of the partition-wall 27. The needle-valve piston 24 has a circular sealing lip 29 which, in all the positions of the piston, prevents the liquid from penetrating into the bore 26. A frusto-conical seat 30 is formed at the end of the outer tube 4 around the discharge orifice 16 in order to cooperate with the needle-valve piston 24.

In addition to the driving piston 31, the moving system of the pump includes a secondary piston 32 formed externally of the outer tube 4 at the lower end thereof. During operation of the pump, the piston 31 slides within the lower portion of the pump body in leak-tight contact with the internal wall of the shell 2 by means of elastic circular lips 33 and 34 (FIGS. 1 and 3) formed respectively at both ends of the piston. The driving piston thus delimits within the shell 2 a first liquid compression chamber 35, the variation in volume of the chamber being apparent from FIGS. 1 and 3 which show the two top and bottom end positions of the piston 31. In regard to the secondary piston 32, this piston slides within the pump body at the level of the sleeve 3 and remains in permanent leak-tight contact with this latter by means of a lower lip 36. The secondary piston closes a second compression chamber 37 which is delimited in this case around the inner tube 5 between the pump body and the driving piston 31 and the volume of which consequently varies inversely with the volume of the first compression chamber 35. Thus the volume of the second chamber is of maximum value in the inactive position of FIG. 1 and of minimum value when the moving element is in its bottom end position as shown in FIG. 3. It will be noted that the ratio of volumes of the two chambers can be preset by suitably choosing the dimensions of the sleeve 3, if only by modifying its length.

The two chambers 35 and 37 communicate with each other via orifices 38 (FIG. 2) which are pierced laterally through the inner tube 5. The second chamber 37 communicates with the discharge orifice 16 via longitudinal ducts 39 which are distributed annularly and formed within the thickness of the moving element. In the case herein described, these ducts are in fact formed between the two tubes 4 and 5 by grooves 41 which are cut lengthwise in the inner tube 5 and open into radial passages 42 at the end of the tube.

A final essential element of the pump is represented by a free-running piston 43 which serves during operation of the pump to control opening and closing of the communication between the two withdrawn-liquid compression chambers. The shape of this piston is identical with that of the precompression needle-valve piston 24 but is oriented vertically in the opposite direction in the axis of the moving element and is located within the inner tube 5 beneath the transverse partition-wall 27. The cylindrical body of the free-running piston is chamfered at least at its upper end in order to cooperate at that point with flexible tongues 44 which are formed by molding from the material of the tube 5 and which project in a circle beneath the transverse partition-wall 27. The tongues 44 have a tendency to thrust the free-running piston 43 downwards but withdraw outwards in order to allow the piston to move upwards between them in the direction of the partition-wall 27 under the action of an excess pressure of liquid which prevails within the chamber 35. The free-running piston 43 is also provided with an external circular lip 45 which moves at the same time along the internal wall of the tube 5 while always remaining beneath the orifices 38. At this level, the tube 5 has a first change in cross-section at 46, with the result that, when the piston 43 is in the bottom position and is thrust downwards by the tongue 44, the lip 45 is in leak-tight contact with the wall of the tube 5 whereas, on the contrary, when the piston 43 is in the top position, the liquid is permitted to flow freely from first compression the chamber 35 to the orifices 38 and the second chamber 37. The tube 5 is provided in addition with a second change in cross-section at 47, the function of which is to limit the possible downward displacement of the piston 43 by abutting application of its lip 45.

Referring now to the operation of the pump in its different stages, it will prove useful to discuss a few complementary details of the construction herein described.

When the pump is in the inactive position as shown in FIG. 1, the discharge orifice 16 is closed by the needle-valve piston 24, the communication between the two compression chambers is cut-off by the free-running piston 43 and the outer tube 4 is applied in leak-tight abutment with the cup 6 by means of an external annular shoulder 48.

The pressure of the liquid within the internal space of the pump is in equilibrium with that of the container, the pump having been started at the end of the previous operating cycle.

When the cycle of downward motion of the moving element 10 begins, the driving piston 31 tends to compress the liquid located within the chamber 35, thus applying the ball 21 against its seat 19 and isolating the chamber from the container. At the same time, the secondary piston 32 moves downwards to the intermediate position of FIG. 2 in which it comes into leak-tight contact with the sleeve 3, not only by means of its lower lip 36 but also by means of an upper lip 49. Since the two lips are oriented slantwise in symmetrical relation, they cooperate in order to close the second chamber 37 in an efficient manner. It is accordingly observed that, under the pressure of the compressed liquid, the free-running piston 43 moves upwards and puts the two chambers into communication with each other and that the liquid which then flows through the ducts 39 above the precompression piston 24 consequently causes the piston to move downwards in opposition to the associated spring 25. The liquid withdrawn from both chambers is therefore discharged through the orifice 16 until the moving element reaches its bottom end position as illustrated in FIG. 3.

In this position, the first chamber 35 attains its minimum volume. This chamber has emptied partly by discharge of a first fraction of the withdrawn dose of liquid but partly also by filling the second chamber 37 whose volume has increased. There then begins the cycle of upward displacement of the moving element which will discharge a second fraction of the withdrawn dose.

In FIG. 3, it is observed that the driving piston 31 is abuttingly applied against the bottom end wall 17 of the shell 2 by means of a ring 51 and that the shell is provided with peripheral projections 50 which have the effect of moving the lip 33 away from the shell wall. The shell is pierced by a lateral orifice 52 which had previously been closed by the piston 31 an which now has the function of pressure equalization between the container and the chamber 35.

When the driving piston is caused to move upwards by the force of the piston 13, the ball 21 is lifted from its seat 19, with the result that the chamber 35 can thus be filled via the liquid withdrawal orifice 20. On the other hand, the free-running piston 43 which is responsive to the thrust exerted by the tongues 44 moves down so as to cut-off the communication between the two chambers and the second chamber 37 empties through the discharge orifice 16.

When the moving element reaches its top position as illustrated in FIG. 1, this represents the end of discharge of the withdrawn dose of liquid. The two lips of the secondary piston 32 are then located on each side of the leakage lugs 9, thus permitting pressure equalization between the container and the second chamber 37.

Figure 4:
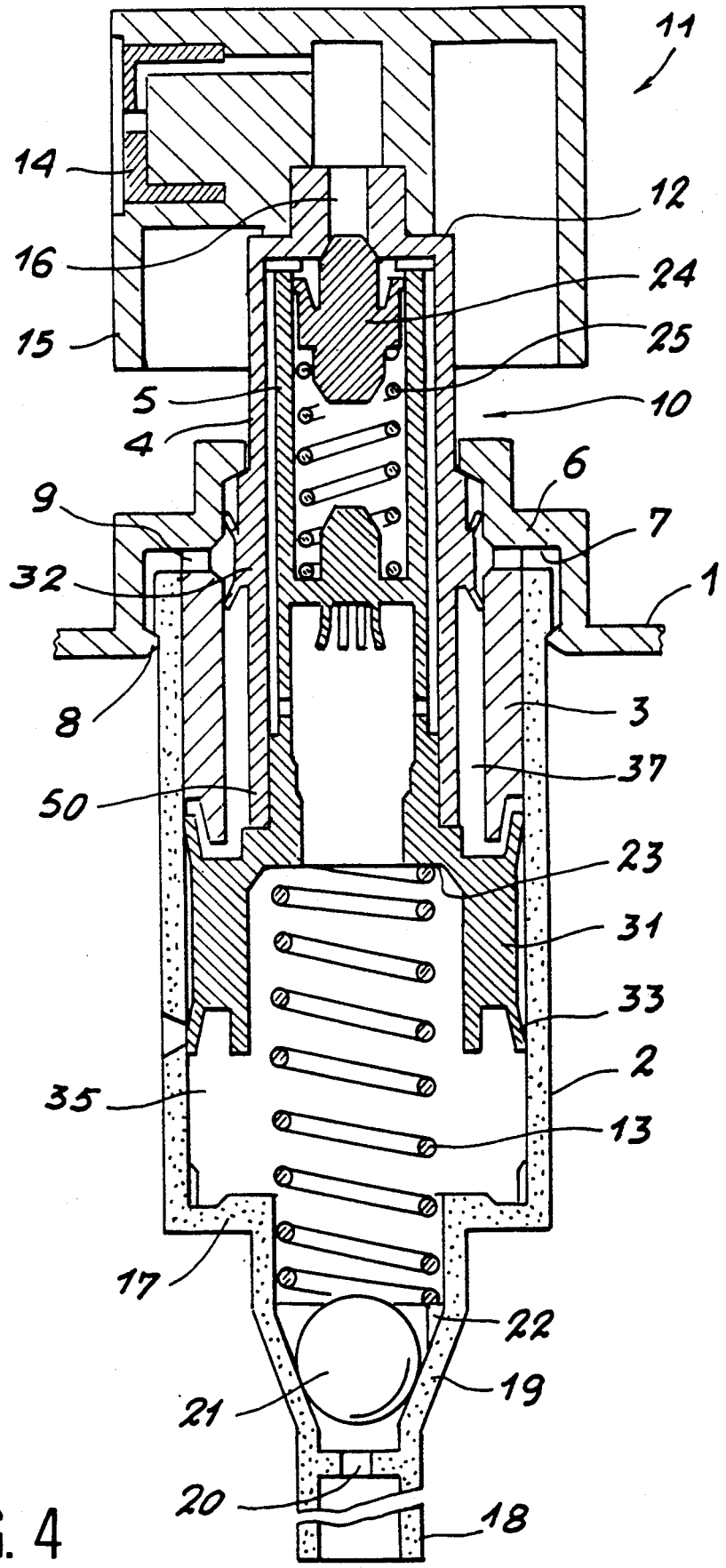
FIG. 4 is a schematic sectional view of an alternative embodiment which applies to the case of a single-acting pump.

In the alternative embodiment of FIG. 4, the pump described in the foregoing has been modified for single-acting operation, the entire withdrawn dose of liquid being discharged during the cycle of downward motion of the moving element. The same references have been used for designating the elements which are common to the double-acting pump and to the alternative embodiment in which the pump operates in the single-acting mode. In this alternative embodiment, the constructional design of the pump differs from the embodiment shown in FIGS. 1 to 3 in the fact that the free-running piston 43 is dispensed with and that the secondary piston 32 has a downward extension in the form of a skirt 50 which is abuttingly applied against the driving piston 31

Figure 5:
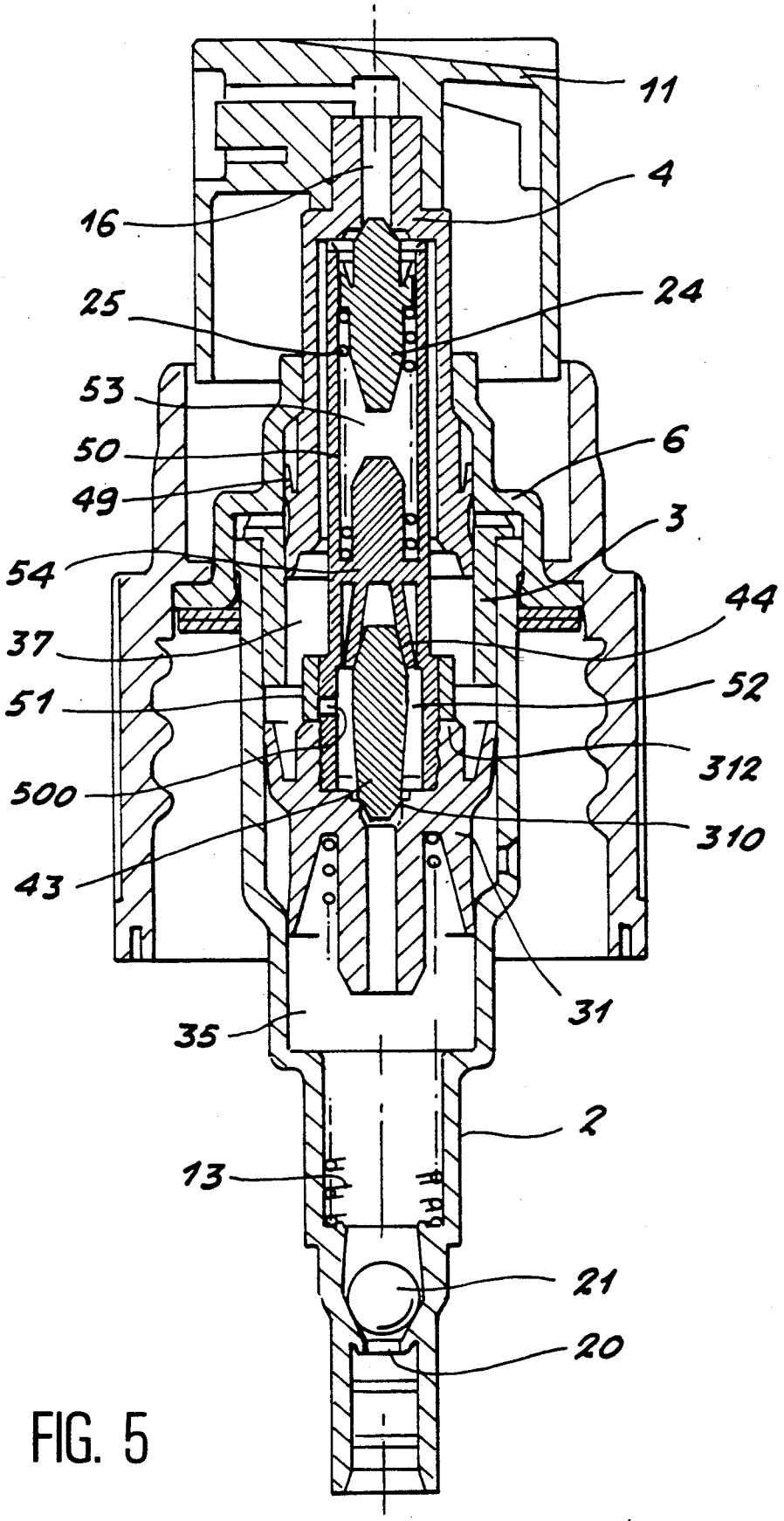
FIG. 5 is a schematic longitudinal sectional view of a second alternative embodiment which applies to a double-acting pump as shown in its inactive position.

Another alternative embodiment of the double-acting precompression pump illustrated in FIG. 5 includes a head 11 for spraying a liquid which arrives through a discharge orifice 16. The orifice 16 is shut-off by a needle-valve piston 24 (of rubber, for example) constituting a second valve which is continuously urged by a first resilient means 25 to the position of closure of the discharge orifice 16. Said discharge orifice 16 is formed along the axis o symmetry of an outer tube 4 in which is mounted an inner tube constituting the moving element 50. The moving element 50 has a first internal space 53 in which are housed the needle-valve piston 24 and the first resilient means 25. Provision is made at the other end of the moving element 50 for a second internal space 52 which forms a third chamber 52 in conjunction with the surface of the driving piston 31 on which the moving element 50 is applied. In its top position, the outer tube 4 is abuttingly applied against the annular shoulders of a cylindrical cup 6. The lower portion of the outer tube 4 is provided with lips 49 which form a leak-tight seal between the cylindrical portion formed by the cup 6 and a sleeve 3 forming an extension of the cylindrical portion of the cup 6. The system consisting of moving element 5 and driving piston 31 is mounted within a shell 2 which constitutes the pump body. A communication between the shell 2 and the liquid to be discharged in spray form is established by means of an orifice 20 shut-off by a first valve 21 constituted for example by a rubber ball. The driving piston 31 is continuously urged to the top position in which it is applied against the moving element 50 by first resilient means 13. This top position corresponds to the position of maximum volume of a first chamber 35 delimited between the bottom face of the driving piston 31 and that portion of the pump body 2 which is shut-off by the first valve 21. The annular space formed between the upper portion of the pump body 2, the outer tube 4, the top surface of the piston 31 and the external surface of the moving element 50 constitutes a second chamber 37. Communication ports 500 formed within the moving element 50 and distributed annularly at its lower end make it possible to put the second chamber 37 into communication with a third chamber 52. These communication ports 500 are shut-off by an elastic sleeve 51 formed of rubber, for example, and placed at the level of the communication ports 500. The sleeve 51 bears on an annular shoulder 312 of the piston 31. The piston 31 is adapted to bear on the circular edge 310 of an orifice for putting the first chamber 35 into communication with the third chamber 52 located in the axis of symmetry of the pump body. This communication orifice is shut-off by a third valve 43 consisting of a needle-valve piston which is continuously urged to its closed position by resilient means 44. By way of example, these resilient means 44 can be obtained by means of tongues 44 which are molded directly with the moving element 50 and made integral with the moving element by means of the dividing wall 54 which separates the internal space 53 from the third chamber 52.

Figure 6:
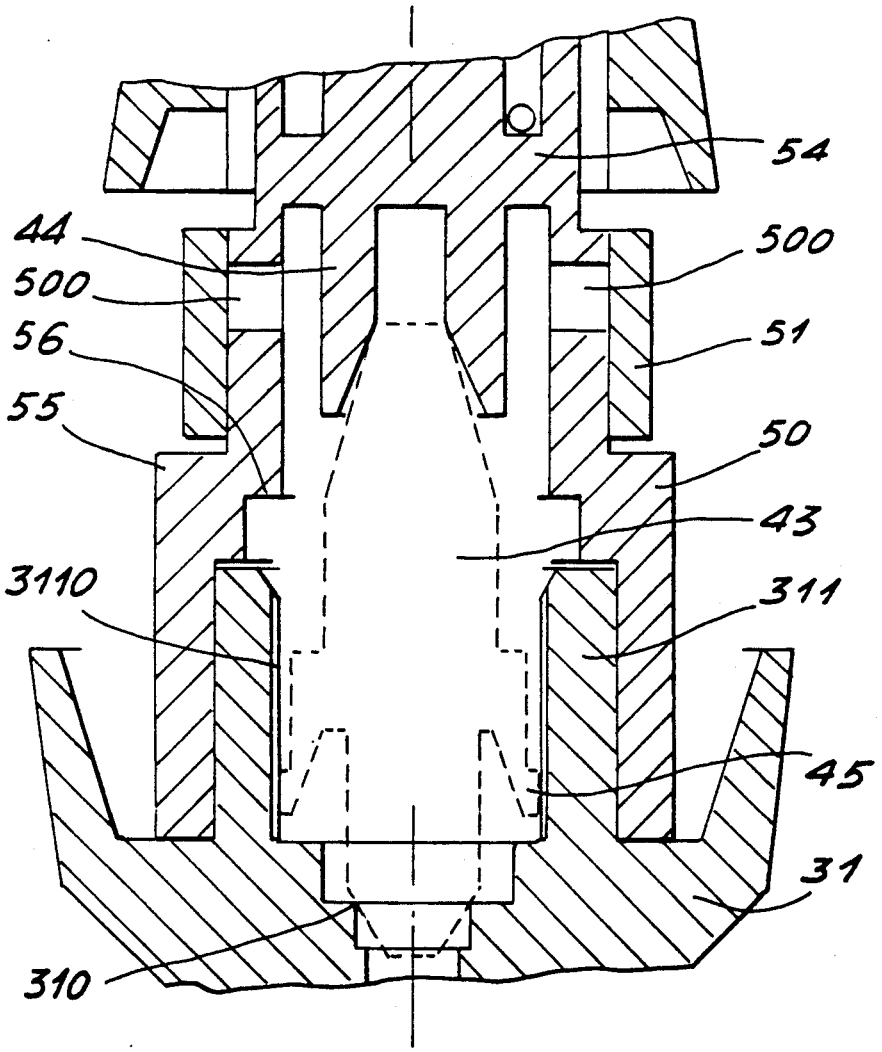
FIG. 6 is a sectional view of a portion of the pump in accordance with a third embodiment.

FIG. 6 illustrates an alternative mode of connection between the moving element 50 and the driving piston 31, said piston being formed in a part which is independent of the moving element 50. The upper portion of the driving piston 31 is provided with a sleeve 311 surrounded by the lower portion of the moving element 50 which forms an annular shoulder 56, the sleeve 311 being abuttingly applied against said shoulder. The lower portion of the moving element 50 which is located above this first annular shoulder 56 has a second annular shoulder 55 on which is applied the elastic sealing sleeve 51 placed around the moving element above the annular shoulder 55. The internal surface of the sleeve 311 of the driving piston 31 has grooves 3110 along which the fluid is permitted to flow between the lips 45 of the needle-valve piston 43 and the bottom of the grooves when the conical end of the needle-valve piston 43 is not applied on the circular edge 310 of the communication orifice of the driving piston 31.

In an alternative embodiment corresponding to a needle-valve piston 43 having lips 45 and mounted within a moving element in accordance with the embodiment of FIG. 1, the grooves are formed in the internal face of the space 52.

Figure 7:
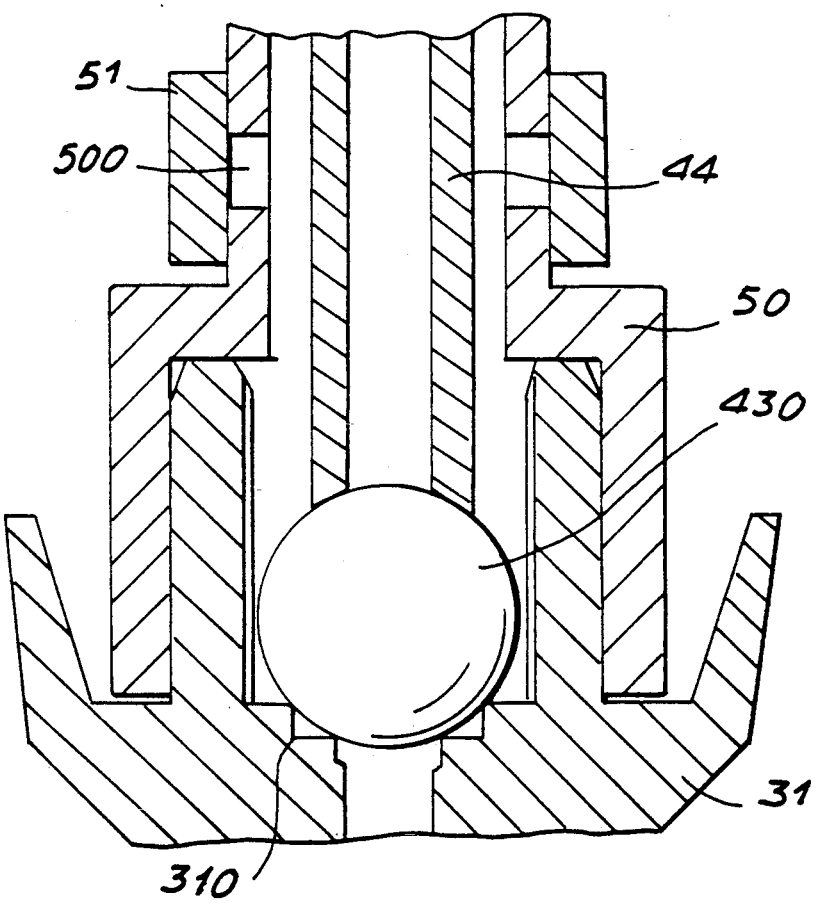
FIG. 7 is a sectional view of a portion of the pump in accordance with a fourth embodiment.

FIG. 7 illustrates an alternative form of construction of the third valve consisting in this case of a rubber ball 430 which rests on the edges of the seat of the orifice 310 of the piston 31. The ball 430 is continuously urged against the seat of the orifice by resilient strips 44 or by any other resilient means such as a spring.

There has thus been described a spray discharge pump, the elements of which can be readily reproduced and assembled automatically and the technical characteristics of which have been improved.

The invention is clearly not limited in any sense to the distinctive features specified in the foregoing or to the details of the particular embodiment which has been chosen in order to illustrate the invention. All kinds of alternatives can be applied to the particular embodiments which have been described by way of example and to their constituent elements without thereby departing from the scope or the spirit of the invention. Thus the invention includes all means which constitute technical equivalents to the means described as well as all combinations thereof.

What is claimed is:

1. A precompression pump for spray discharge of a liquid, wherein said pump includes a first inner compression chamber formed within a pump body between a valve for closing an orifice through which liquid is withdrawn from a storage container and a discharge orifice through which the withdrawn liquid is expelled to a spray-discharge head, the volume of said first chamber being variable by reason of the fact that said chamber is limited by a driving piston which is thrust axially by a moving element within said pump body and continuously urged by first resilient means towards a position corresponding to the maximum volume of the first chamber, and a second intermediate chamber between said first chamber and said discharge orifice which is shut-off by a second valve forming the precompression system and mounted within an internal space of said moving element, said second valve being urged by second resilient means to a position of closure of the discharge orifice from which said second valve is withdrawn in spite of the action of the second resilient means when the liquid is pressurized within the second chamber, said moving element being provided with communication ports which are distributed annularly and open laterally towards the second chamber on an elastic sealing sleeve mounted on the periphery of the moving element at the level of said communication ports, the sleeve being mounted between the second chamber and a third chamber, the moving element being applied directly on the driving piston, a third valve placed within the third chamber which is internal to said moving element being urged by third resilient means towards the driving piston to a position in which it closes an orifice of the driving piston which puts the third chamber into communication with the first chamber.

2. A pump according to claim 1, wherein the second and third valves are needle-valve pistons of rubber.

3. A pump according to claim 1, wherein the first and third valves are rubber balls.

4. A precompression pump according to claim 1, wherein the third chamber has longitudinal grooves parallel to the axis of symmetry of the pump body.

5. A precompression pump according to claim 2, wherein the third chamber has longitudinal grooves parallel to the axis of symmetry of the pump body.

6. A precompression pump according to claim 3, wherein the third chamber has longitudinal grooves parallel to the axis of symmetry of the pump body.

7. A pump according to claim 4, wherein the grooves are formed in part of the moving element.

8. A pump according to claim 4, wherein the grooves are formed in the driving piston.

9. A pump according to claim 1, wherein the driving piston is a part which is independent of the moving element.

10. A pump according to claim 2, wherein the driving piston is a part which is independent of the moving element.

11. A pump according to claim 3, wherein the driving piston is a part which is independent of the moving element.

12. A pump according to claim 4, wherein the driving piston is a part which is independent of the moving element.

13. A pump according to claim 5, wherein the driving piston is a part which is independent of the moving element.

14. A pump according to claim 6, wherein the driving piston is a part which is independent of the moving element.

* * * * *

UNITED STATES PATENT AND TRADEMARK OFFICE

CERTIFICATE OF CORRECTION

PATENT NO. : 5,092,495

DATED : March 3, 1992

INVENTOR(S) : Andre DeBard

It is certified that error appears in the above-identified patent and that said Letters Patent is hereby corrected as shown below:

Column 2, line 10, "subject" should be --subjected--.

Column 4, line 26, "a internal" should be --an internal--.

Column 7, line 20, "31 an which" should be --31 and which--.

Column 7, line 61, "axis o" should be --axis of--.

Column 7, line 67, "conjunction" should be --conjunction--.

Signed and Sealed this

Seventh Day of September, 1993

Bruce Lehman

*Attest:*

BRUCE LEHMAN

*Attesting Officer*

*Commissioner of Patents and Trademarks*